United States Patent [19]

Gillette

[11] 4,179,855

[45] Dec. 25, 1979

[54] INSERT FOR HONING TOOL

[75] Inventor: Robert H. Gillette, Angola, Ind.

[73] Assignee: Brammall, Inc., Angola, Ind.

[21] Appl. No.: 898,924

[22] Filed: Apr. 24, 1978

[51] Int. Cl.[2] ..... B24B 33/00

[52] U.S. Cl. ..... 51/204; 51/346

[58] Field of Search ..... 51/204, 205, 330, 331, 51/332, 334, 335, 336, 337, 338, 339, 340, 341, 342, 343, 344, 345, 346, 347, 348, 349, 350, 351, 352, 211, 214

[56] References Cited

U.S. PATENT DOCUMENTS

| | | | |
|---|---|---|---|
| 935,350 | 9/1909 | Badge et al. | 51/205 R |
| 1,147,510 | 7/1915 | Johnson | 51/204 X |
| 1,775,230 | 9/1930 | Wacker et al. | 51/343 |
| 1,886,584 | 11/1932 | Prange | 51/204 |
| 2,467,094 | 4/1949 | Peden | 51/346 |
| 2,581,601 | 1/1952 | Peden et al. . | |
| 2,903,828 | 9/1959 | Eldred | 51/204 |
| 3,109,266 | 11/1963 | Engle . | |
| 3,123,945 | 3/1964 | Engle . | |
| 3,195,280 | 7/1965 | Crowe . | |
| 3,403,481 | 10/1968 | McDonald . | |
| 3,507,077 | 4/1970 | Magsig . | |
| 3,810,333 | 5/1974 | Gillette . | |
| 3,995,400 | 12/1976 | Gillette | 51/338 |

*Primary Examiner*—Harold D. Whitehead
*Assistant Examiner*—Robert P. Olszewski
*Attorney, Agent, or Firm*—Hill, Van Santen, Steadman, Chiara & Simpson

[57] ABSTRACT

An improved insert is disclosed for use with a honing tool for retaining an abrasive element while mechanically isolating the abrasive element from the remainder of the honing tool. The improved slot liner is in the form of a bushing having four interconnected wall sections extending generally parallel to one another and including an arrangement for holding the bushing fixedly within the body of the honing tool. A slot at one end and a flexible curved spring member at the other end of the insert provide for improved, spring-loaded gripping characteristics of the insert. The abrasive element is additionally supported and retained due to frictional forces on the other bushing surfaces.

6 Claims, 6 Drawing Figures

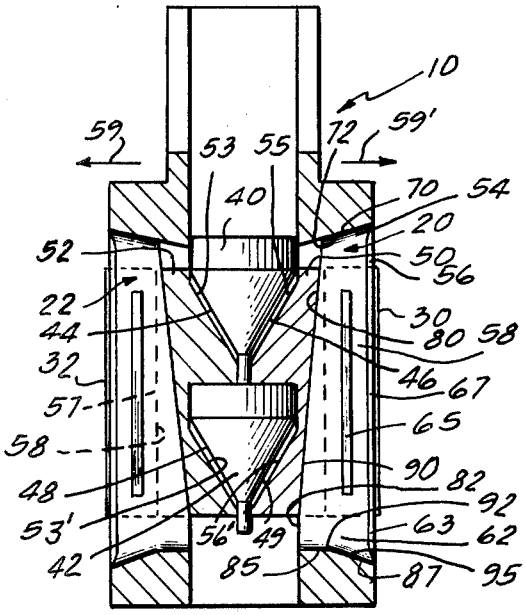
Fig. 1
Fig. 2
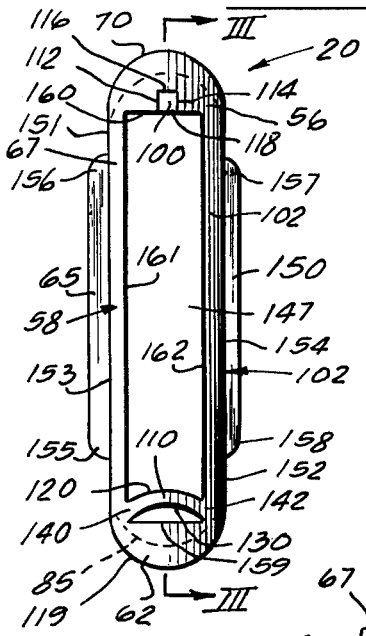
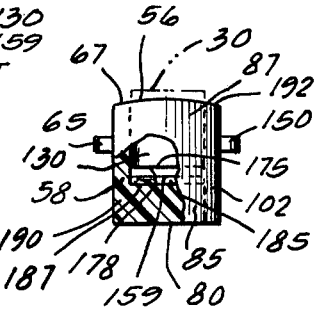
Fig. 4
Fig. 3
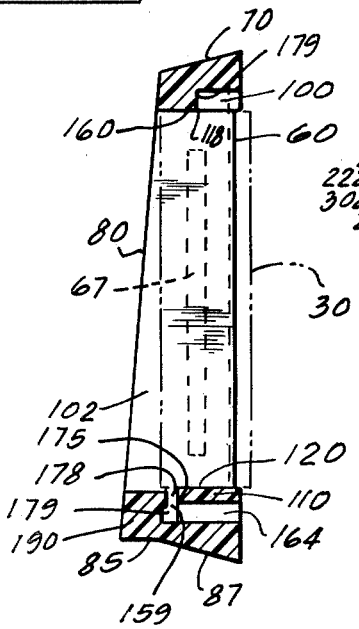
Fig. 5
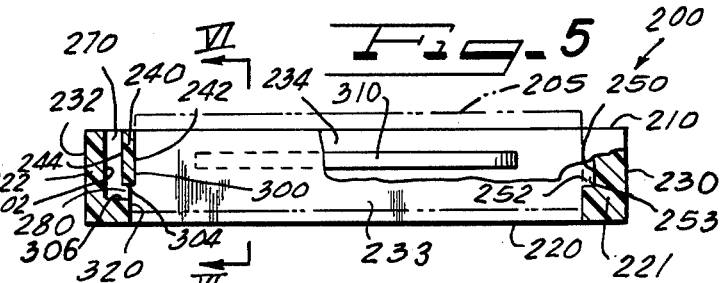
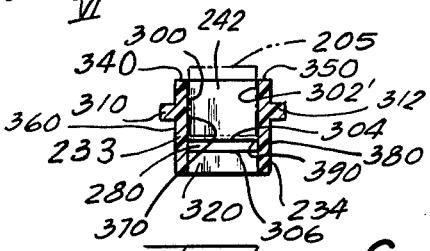
Fig. 6

INSERT FOR HONING TOOL

BACKGROUND OF THE INVENTION

1. Field of the Invention

This invention relates generally to the field of abrasive holders or inserts for honing tools. In particular, inserts for honing tools used in conjunction with mechanical honing devices.

2. Prior Art

Inserts for use with honing tools are well known in the art. U.S. Pat. No. 3,995,400 discloses a honing tool slot liner having generally rectangular shape. The honing stones are mounted therein and the assembly is in turn completely mounted within the honing device. Lips or ridges hold the bushing fixedly within the body of the honing tool. Other examples may be found in U.S. Pat. Nos. 3,507,077 and 3,403,481.

SUMMARY OF THE INVENTION

The invention is an improved insert or bushing mechanism for use with a honing tool. A typical bushing has an interior region of generally rectangluar shape wherein the honing stone, also cut to match that shape, is inserted. The bushing with the stone is then clamped together and presed into the recess in the honing tool. The improvement lies in changes made to the narrow sides of the interior region. At one end of the interior region of the improved bushing is a slot. At the other end is placed a curved spring member extending toward the honing stone. Both the slot and the curved member improve the holding characteristics of the bushing with respect to the honing stone. The curved member provides a spring loading to clamp the honing stone against the slotted end of the holder. The slot provides additional flexibility so that as the insert is pressed into the honing tool recess, the tool may clamp it tightly and force it to exert additional frictional forces against the honing stone. The insert is held within the recess of the honing tool by means of a pair of lips or ridges extending perpendicular to the sides of the insert which engage appropriately positioned slots within the honing tool. Externally, based on the holding tool, the insert may take on either a generally rectangular cross section or a trapezoidal-type of cross section.

BRIEF DESCRIPTION OF THE DRAWINGS

FIG. 1 is a partial elevated section of a honing tool utilizing the insert of the present invention;

FIG. 2 is a planar frontal view of the insert of the present invention viewed from the workpiece side;

FIG. 3 is a section taken along the line III—III of FIG. 2 indicating the interior structure of the improved bushing;

FIG. 4 is a fragmentary top planar view showing the structure of the spring end of the improved bushing;

FIG. 5 is a planar cross section of a second embodiment of the present invention; and FIG. 6 is a section taken along the line VI—VI of FIG. 5 showing the spring structure in the second form of the present invention.

DESCRIPTION OF THE PREFERRED EMBODIMENTS

While the principles of the present invention find a particular utility in an insert for a honing tool, it will be understood that the arrangement of the present invention may be utilized in other combinations. By way of exemplary disclosure of the best mode of practicing the invention, there is shown generally in FIG. 1 a cross section of a prior art honing tool, such as described in U.S. Pat. No. 3,995,400, using one variety of the insert of the present invention. A rotary honing tool 10 is shown utilizing a pair of inserts 20 and 22 each of which supports a honing stone 30, 32 with a rectangular cross section: conical expansion mechanisms 40, 42 with a corresponding pair of surfaces 44, 46 and 48, 49 which cooperate with a pair of expansion blocks 50, 52 to drive the stones 30 and 32 toward the workpiece surface.

A set of surfaces 53, 53' on the expansion block 52 mates with the surfaces 44, 48 of the expansion members 40, 42 driving the block 52 horizontally so that a front surface 57 presses against a rear surface 58 of the stone 32 pushing the stone horizontally 59 toward the work surface. The block 50 has a set of surfaces 55, 56' which mate with a set of surfaces 46, 49 of the expansion elements 40, 42 to drive the stone 30 horizontally in the direction 59'.

The inserts 20 and 22 are identical so the following description of the insert 20 will also apply to the insert 22. The insert 20 has a top member 54 which has a curved front surface 56. A side wall 58 joins a bottom member 62 which has a curved front surface 63. A tab 65 is affixed to the side wall 58. The tab 65 cooperates with a recess within the tool 10 into which the insert is placed. The wall 58 has a front surface 67 which intersects the curved surfaces 56 and 63 of the top 54 and the bottom 62 of the insert 20. A surface 70 of the top 54 is at an acute angle with respect to the curved front surface 56 of the top 54. The exact angle of the surface 70 is selected to match the angle of a surface 72 of the honing tool 10 which is adjacent to the surface 70 of the insert 22. A rear surface 80 connects the surface 70 to a surface 82 which is substantially parallel to the axis of rotation of the tool 10. The surface 82 is on the exterior rear of the bottom member 62. Also on the bottom member 62, a surface 85 intersects the surface 82 at substantially a right angle and also intersects a front bottom surface 87 which is at an acute angle to the front surface 63 of the bottom 62. A set of surfaces 90, 92, and 95 in the recess of the tool 10 determine the exact angles necessary for the surfaces 80, 85 and 87.

FIG. 2, a front view of the insert 20 discloses the top member 54 with a slot 100 of substantially square cross section positioned midway between the side wall 58 and a second parallel side wall 102. The slot 100 has a pair of walls 112, 114 and a top 116. A line 118 defines the bottom edge of the rear of the slot 100. The top member 54 is connected to the sidewall 58 having the front surface 67. The sidewall 58 is connected to the bottom 62. A front edge 119 is the intersection between the front bottom surface 87 and the front surface 63 of the bottom 62. A spring member 110 with a curved top surface 120 and a curved bottom surface 130 is connected between an intersection 140 of the sidewall 58 and the bottom 62 and an intersection 142 between the bottom 62 and the second sidewall 102 parallel to the wall 58. The two walls 58, 102 along with the top member 54 and the bottom member 62 form the aperture 147 into which the honing stone 30 is placed. A tab 150 corresponding to the tab 65 is affixed to the sidewall 102. The tabs 65 and 150 intersect the walls 58 and 102 at the outside surfaces 151, 152 along a pair of lines 153, 154 respectively. The tab 65 has a pair of rounded corners 155, 156 while the tab 150 has a pair of rounded corners 157, 158. A line 159 in the bottom 62 is a corner of the rear of the bottom 62 where the spring 110 has been isolated from the bottom 62.

The effect of the upward extending spring member 110 is to force the honing stone 30 against a surface 160 on the inside of the top member 54. Further, the effect of the slot 100 is to permit the top member 54 to flex slightly thereby allowing an interior surface 161 and a surface 162 of the walls 58, 102 to be pressed against the sides of the honing stone 30 thereby increasing the frictional forces gripping that stone.

FIG. 3, a section view taken along line III—III, of FIG. 2 shows the slot 100 extending back into the body of the insert 20 and the curved member 110 isolated from the insert 20 except at the regions 140, 142. As can be seen, there is an open region 164 beneath the spring member 110 wherein the member 110 may deform under pressure. The position of the honing stone 30 is indicated in FIG. 3 within the body member and as can be seen it is clamped between the walls 58, 102, the top surface 160 which cooperates with the slot 100 and the top curved surface 120 of the spring member 110. The spring member 110 is isolated at a rear surface 175 by a slot 178 which also allows the spring member 110 to flex under compression. A rear undercut portion 179 of the slot 164 joins the slot 178. The slot 64 is terminated by a rear wall 179.

FIG. 4, a fragmentary bottom view illustrates the detail of the spring member 110. The bottom surface 130 of the spring member 110 is terminated at the rear edge 175. The region 178 separates the rear edge 175 of the spring 110 from the corner 159 of a ledge 185 on a rear wall 187 of a rear portion 190 of the bottom 62. It should be noted that while the two side walls 58, 102 are parallel, the front surface 67 of the wall 58 and a front surface 192 of the wall 102 are not parallel due to the curvature imposed on the insert 20 which is evident in the curved front surface 56 of the top 54.

FIG. 5, a section view shows a second insert which includes the invention claimed herein having a generally rectangular exterior body structure with a rectangular aperture and containing the honing stone within that generally rectangular interior region. An insert or holder 200 which contains a honing stone 205 has a front surface 210, a parallel rear surface 220, a top 221, a bottom 222 having a pair of parallel end surfaces 230, 232 and a pair of sidewalls 233, 234. A spring member 240 with a top surface 242 and a bottom surface 244 operates in conjunction with a slot 250 with a rear wall 252 and a top 253 to improve the holding characteristics of the insert 200. The spring 240 is isolated from the body of the insert 200 by a lower space 270 and a connecting perpendicular slot 280 such that the only contacts the spring member 240 has with the insert 200 occur where the wall members 233, 234 intersect the bottom 222. One such intersection occurs at a corner 300. The slot 270 has a bottom 302. The slot 280 has a pair of sides 304, 306.

FIG. 6, a section taken along line VI—VI of FIG. 5 shows a pair of tabs 310, 312 joined to the walls 233, 234 which cooperate with slots in the tool to retain the insert 200. The stone 205 within the tool holder 200, the top 242 of the spring member 240 connected to the tool holder 200 at the corners 300 and 302' and the isolating slot 280 at the rearwall 304 of the spring member 240. The lower surface 320 is the top side of the bottom 222 of the holder 200. In this version of the invention, as previously, the spring member 240 operates in conjunction with the slot 250 to improve the holding power of the insert 200 with respect to the stone 205.

It should be noted that whereas the surfaces 67 and 192 of the first embodiment are not parallel to one another due to the curvature imposed on the insert 20, a corresponding pair of surfaces 340, 350 of FIG. 6 are parallel due to a lack of curvature being imposed on the insert 200. Further, the sidewall 233 has an external surface 360 and an internal surface 370 adjacent to the honing stone 205 parallel to an external surface 380 and an internal suface 390 of the wall 234.

The preferred material for the inserts described and claimed herein is nylon.

Although various modifications might be suggested by those skilled in the art, it should be understood that I wish to embody within the scope of the patent warranted hereon all such modifications as reasonably and properly come within the scope of my contribution to the art.

I claim as my invention:

1. An improved insert for a honing tool comprising:
a one piece body,
said body having two parallel elongated side members in spaced relation to one another,
a top member joining said two parallel side members, a bottom member having a first and a second end and joining said two parallel side members;
said two parallel side members, said top member and said bottom member forming an aperture wherein a honing stone can be inserted;
a curved spring member molded into said body at a first end and a second end with said first end of said spring being molded to said body where said first end of said bottom member intersects a first of said two side members and with said second end of said spring being affixed to said body where said second end of said bottom member intersects a second of said two side members and having a central region that extends into said aperture;
said central region of said spring member being movable independently of said body and operable to clamp the honing stone within the aperture against said top member as that honing stone is slid within said insert by the tool; and retaining means operative to retain said insert in a tool into which it has been inserted.

2. The improved insert of claim 1 with said top member having a slot adjacent to said aperture at a selected angle to said front surface of said top member.

3. The improved insert of claim 1 with said front surface having a selected curvature.

4. An improved insert for a honing tool having a one-piece body having two substantially parallel sides in spaced relation to one another with a top member joining a first end of each of the two parallel sides, with a bottom member joining a second end of each of the two parallel sides forming an interior region defined by the two parallel sides, the top and the bottom members; the improvement comprising:
a curved spring member having a first and a second end and with said first end of said spring molded to said body where said second end of said one of said two parallel sides intersects said bottom member and with said second end of said spring molded to said body where said second end of said second of said two parallel sides intersects said bottom member, and with a curved central region of said spring extending into the interior region and wereby said curved central region of said spring member is movable independently of the body and operable to clamp a honing stone within the interior region against the top member as that honing stone is slid within said insert by said tool.

5. The improved insert according to claim 4 having additionally a slot in said top member, adjacent to said interior region, with a substantially square cross section;

said slot being operative to enable said top member to flex under forces applied by the tool into which said insert has been inserted thereby increasing the holding forces exerted upon the honing stone by said two parallel sides.

6. An improved one-piece, insert for use with a rotary honing tool having a known radius, the insert having a one-piece body with a pair of elongated, parallel side walls in spaced relation to one another, an upper member joining a first end of each of the two side walls, a lower member joining a second end of each of the two side walls;

the two side walls, the upper and the lower members forming an elongated interior region capable of receiving a honing stone which partially extends from a front side of the body;

the improvement comprising:

a curved surface on said upper member on the front side of the body, a curved surface on said lower member on the front side of the body, a curved surface on an elongated edge of each sidewall on the front side of the body each of said curved surfaces having a radius corresponding to the known radius of the honing tool which is to receive said improved insert;

a curved spring member having a first and a second end and with said first end of said spring molded to said body where said second end of said one of said two parallel sides intersects said bottom member and with said second end of said spring molded to said body where said second end of said second of said two parallel sides intersects said bottom member, whereby a central portion of said curved spring member extends into the interior region and is movable independently of the body and operable to clamp a honing stone within the interior region against the top member as that honing stone is slid within said insert by the tool.

* * * * *